United States Patent [19]

Long, III

[11] Patent Number: 4,875,309

[45] Date of Patent: Oct. 24, 1989

[54] DISC CLEANER

[75] Inventor: William W. Long, III, Hagerstown, Md.

[73] Assignee: Pangborn Corporation, Hagerstown, Md.

[21] Appl. No.: 134,092

[22] Filed: Dec. 17, 1987

[51] Int. Cl.[4] ..... B24C 3/14

[52] U.S. Cl. ..... 51/419; 51/215 SF; 198/625; 198/415

[58] Field of Search ..... 51/417, 419, 215 SF, 51/215 AR, 215 HM; 198/625, 415, 411, 662, 663, 676, 657

[56] References Cited

U.S. PATENT DOCUMENTS

| | | | |
|---|---|---|---|
| 1,216,039 | 2/1917 | Wyman et al. | 51/215 SF |
| 1,741,981 | 12/1929 | Dewey et al. | 51/419 |
| 2,154,878 | 4/1939 | Turnbull | 51/419 |
| 2,584,587 | 2/1952 | Huyett | 51/215 SF |
| 2,592,275 | 4/1952 | Grosvenor | 198/657 |

FOREIGN PATENT DOCUMENTS

| | | | |
|---|---|---|---|
| 0083071 | 4/1935 | Sweden | 51/215 SF |

*Primary Examiner*—Robert Rose

*Attorney, Agent, or Firm*—Charles E. Brown; Charles A. Brown

[57] ABSTRACT

This relates to a disc cleaning machine wherein abrasives are thrown at a disc as it travels along a predetermined path and wherein the disc is rotated as it travels along that path. A principle feature of the machine is that discs are conveyed along a path by a pair of cooperating screw type conveyors while the discs are supported on a pair of support shafts which rotate and rotate the discs so as to ever changingly present surface portions of the discs to the abrasives. The workpieces are automatically fed into the machine by way of a notched feed wheel and at the end of the cleaning operation, the workpieces drop off of the support shafts and down a discharge chute so that the operation is automatic.

15 Claims, 2 Drawing Sheets

DISC CLEANER

This invention relates in general to new and useful improvements in abrasive cleaning apparatus, and more particularly to a disc cleaner for cleaning circular plate-like members including rotors and brake drums.

In the past, rotors and brake drums have been cleaned using a twin screw concept to convey the workpiece through the blast machine for cleaning. The production of such cleaning equipment is dependent on the screw pitch and R.P.M. In order to adequately clean the workpiece, it must be rotated at a speed compatible with the transverse velocity. In the present twin screw system, the workpiece R.P.M. is determined by the screw type conveyor R.P.M. which, in turn, is established by the production rate and pitch of the screw type conveyor. In all cases, rotation has been too slow to present proper angles of blast for acceptable cleaning.

In accordance with this invention, separate drive means are provided for the screw type conveyors which advance the discs being cleaning along the machine and the support shafts which rotate the discs as they are being conveyed.

In accordance with this invention, the support shafts are also provided with a friction surface and are supported adjacent discharge ends thereof by a centrally located rotating collar in conjunction with idler shafts.

Workpieces to be cleaned utilizing the equipment of this invention are automatically fed into the screw type conveyors utilizing a notched rotating wheel or disc which is driven in unison with the screw type conveyors.

Cleaned discs are automatically discharged at the opposite ends of the screw type conveyors into a discharge trough.

With the above and other objects in view that will hereinafter appear, the nature of the invention will be more clearly understood by reference to the following detailed description, the appended claims, and the several views illustrated in the accompanying drawings.

Figure 1:
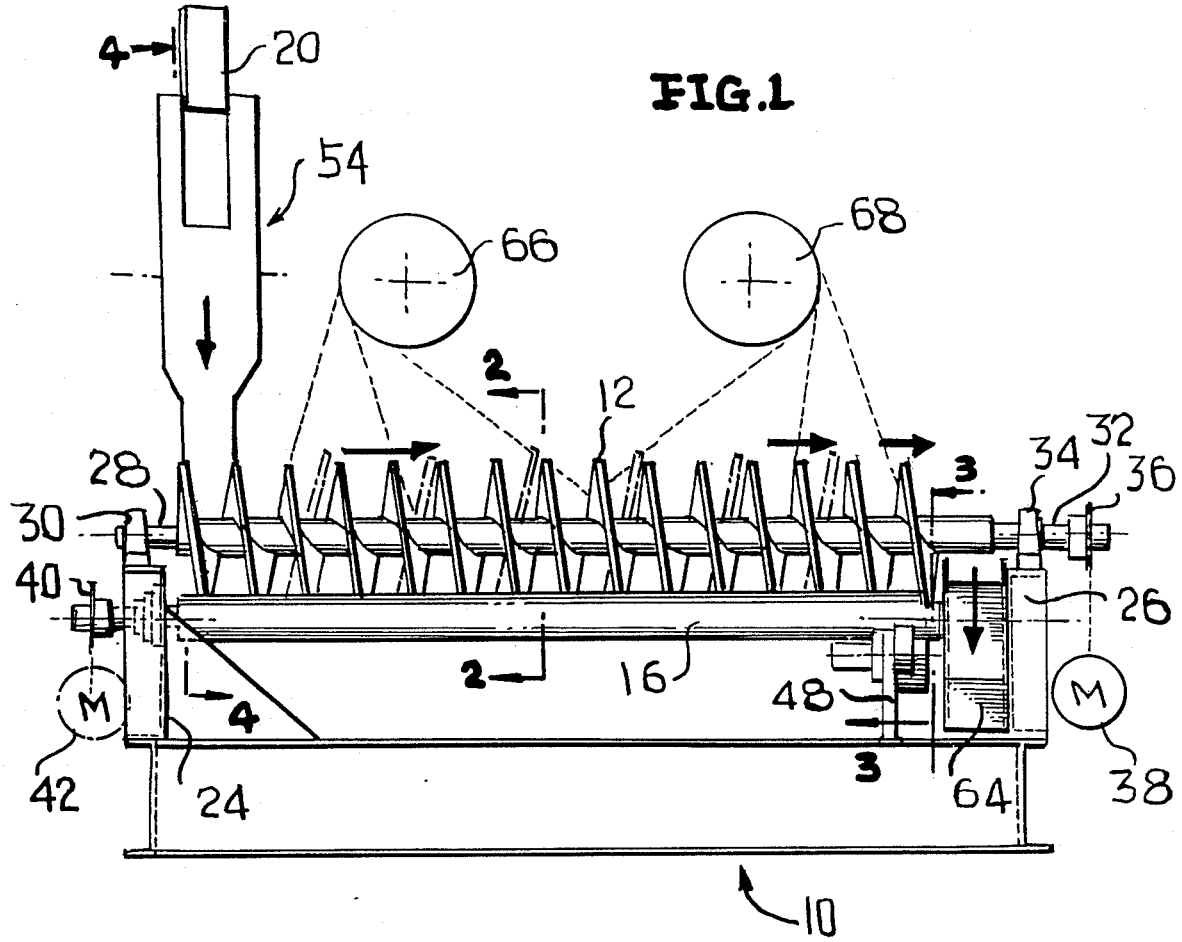
FIG. 1 is a schematic side elevational view of the disc cleaning machine and shows the general details thereof.
Figure 2:
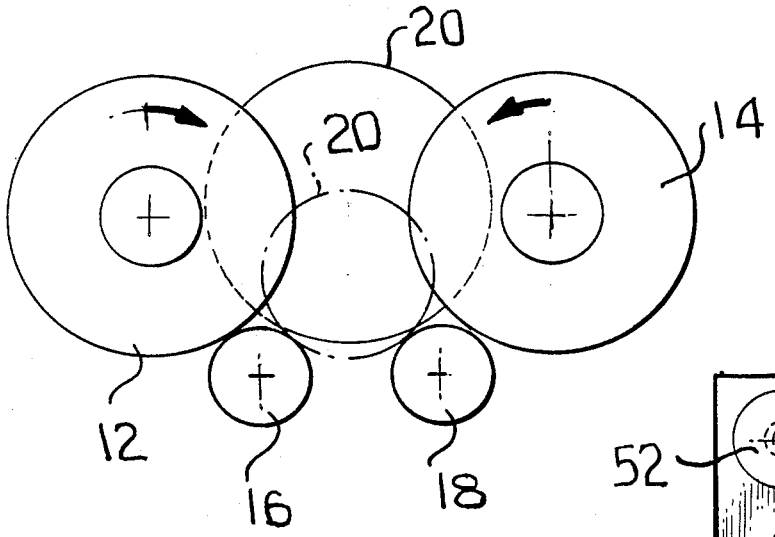
FIG. 2 is an enlarged fragmentary vertical sectional view taken generally along the line 2—2 of FIG. 1 and shows the specific arrangement of screw type conveyors and support shafts.
Figure 6:
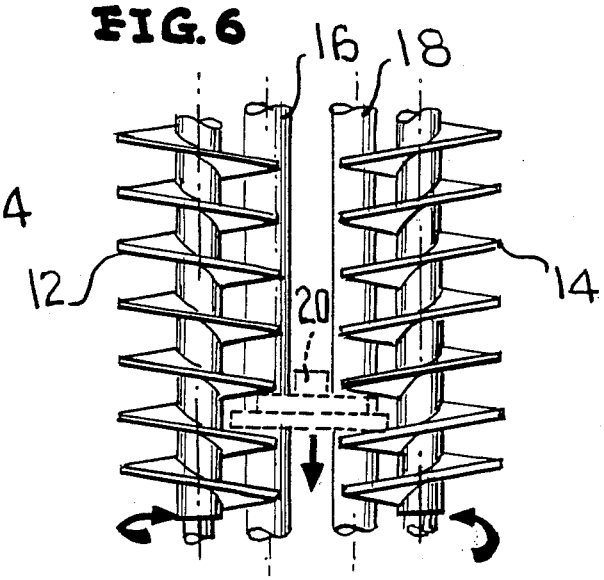
FIG. 6 is a schematic fragmentary plan view of the central portion of the feed mechanism and shows the specific mounting of a disc for cleaning.

Referring now to the drawings in detail, reference is first made to FIG. 1 wherein there is illustrated the disc cleaning machine which is the subject of this invention, the machine being generally identified by the numeral 10. As is best illustrated in FIGS. 2 and 6, the principle elements of the feed mechanism of the disc cleaning machine 10 is a pair of screw type conveyors 12, 14 which are arranged in spaced parallel relation with the conveyors 12 and 14 being of different hand and rotating simultaneously in different directions as is indicated by the arrows in FIG. 2.

Associated with the conveyors 12, 14 is a pair of support shafts 16, 18 which are also in parallel relation. The support shafts 16, 18 are disposed in spaced relation below and generally inwardly of the conveyors 12, 14 as is also best shown in FIG. 2. In the operation of the disc cleaning mechine 10, a disc type workpiece 20 to be cleaned is dropped in between the two conveyors 12, 14 and seats on the support shafts 16, 18. In accordance with this invention, the support shafts 16, 18 are driven independently of the conveyors 12, 14 so that as the workpiece 20 is moved longitudinally through the machine 10 by the conveyors 12, 14, it is also rotated by the support shafts 16, 18.

Returning to FIG. 1, it will be seen that the machine 10 includes a base 22 having upstanding supports 24 and 26, the support 24 being at the head end of the machine and the support 26 being at the discharge end of the machine. The conveyors 12, 14, at the head end thereof, are provided with shaft portions 28 which are mounted in bearing blocks 30 carried out by the upstanding support 24.

At the discharge end of the machine, the conveyors 12, 14 are also provided with shafts 32 which are journalled in and extend through bearing blocks 34 which are carried by the upstanding support 26. The shafts 32 have mounted on the ends thereof beyond the bearing blocks 34, sprockets 36 through which they are driven by means of a suitable motor 38. If desired, a variable speed unit may be associated with the motor 38 so as to vary the speed of rotation of the conveyors 12, 14.

The head ends of the support shafts 16, 18 are suitably journalled for rotation within the upstanding support 24. The other ends of the support shafts 16, 18 are mounted in a manner described hereinafter.

The support shafts 16, 18 are driven by means of sprockets 40 which are driven by means of a motor 42 which may also be provided with a suitable conventional variable speed drive so as to selectively vary the speed of rotation of the support shafts 16, 18.

Figure 3:
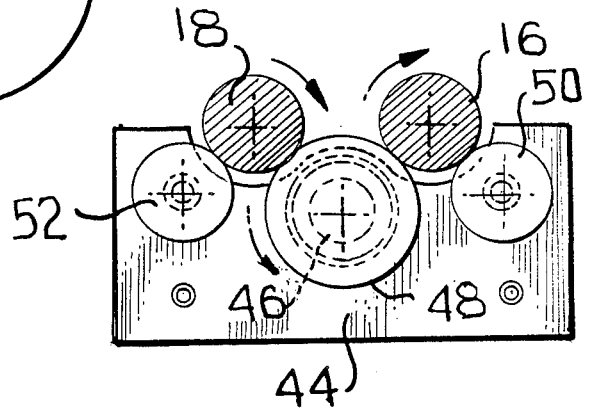
FIG. 3 is a schematic transverse vertical sectional view taken generally along the line 3—3 of FIG. 1 and shows the supporting of the discharge ends of the support shafts.

With particular reference to FIG. 3, it will be seen that there is upstanding from the base an upstanding support 46. A shaft 46 is rotatably journalled in the support 44 and carries a collar 48 which extends upwardly between the support shafts 16, 18 and is in supporting engagement therewith.

The support 44 also is provided with idler shafts 50, 52 which are transversely aligned with the collar 48 and underlie and supportingly engage the support shafts 16, 18.

At this time, it is to be noted that at a minimum, the support shafts 16, 18 have a friction surface and are preferably formed of a suitable friction type material including hard rubber, etc. Thus there is a good frictional driving connection between the support shafts 16, 18 and the workpiece so that the workpiece will be positively rotated.

Figure 4:
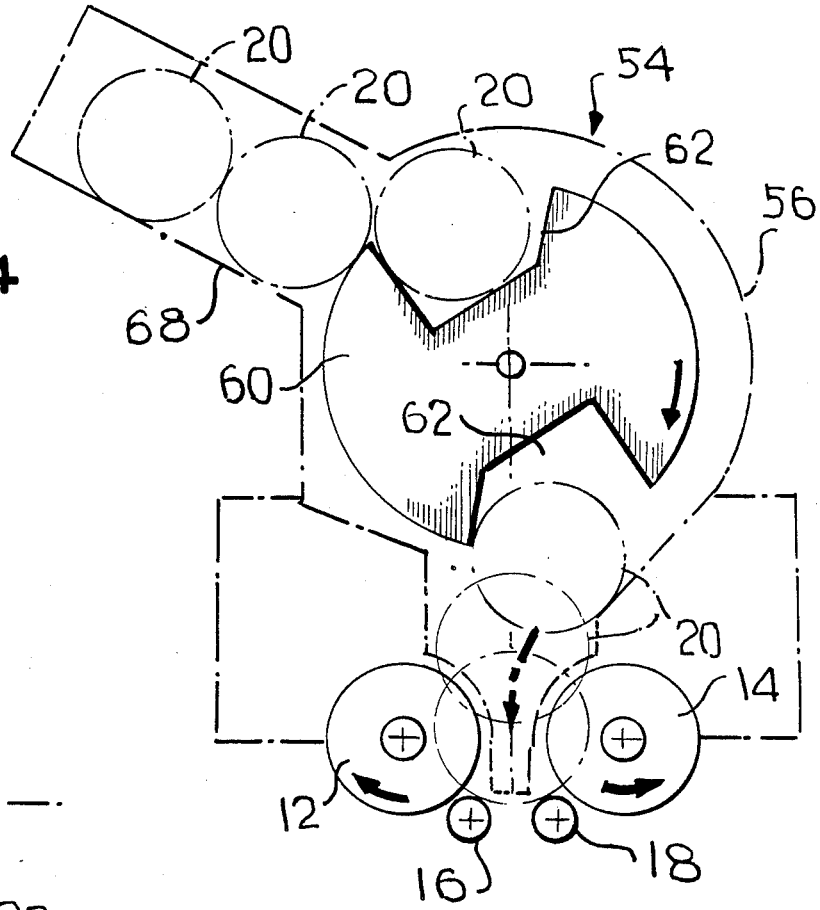
FIG. 4 is a schematic transverse vertical sectional view taken generally along the line 4—4 of FIG. 1 and shows the specific details of the workpiece feed mechanism.

The machine 10 is provided at the head end thereof with an automatic workpiece feeder, generally identified by the numeral 54. The feeder 54 is schematically illustrated in FIG. 4 and includes a housing 56 having a magazine or hopper portion 58 in which workpieces are stored in sequence. Within the housing 56 there is mounted for rotation a loader wheel 60 having diametrically opposite workpiece receiving notches 62. The loader wheel 60 is mounted for rotation with respect to the housing 56 and is driven from one of the conveyors 12, 14 in a conventional manner at the same speed as the conveyors 12, 14. Of course, the loader wheel 60 has the notches 62 thereof oriented with respect to the conveyors 12, 14 so that the timing of the dropping of a workpiece into the conveyors 12, 14 is correct.

At this time it is also pointed out that the relationship of the conveyors 12, 14 to one another and to the support shafts 16, 18 is one wherein workpieces of different diameters may be readily accommodated. When smaller diameter workpieces are to be fed by the loader wheel, suitable inserts may be placed within the notches 62.

Figure 5:
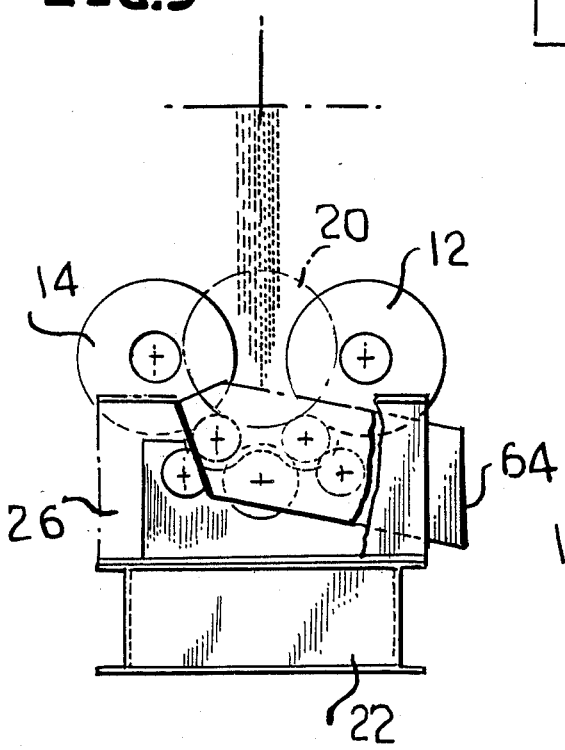
FIG. 5 is a schematic end elevational view of the apparatus showing the discharge chute.

It will be understood that the support shafts 16, 18 terminate generally at the collar 48. Thus when the workpieces reach the ends of the support shafts, which is generally also at the ends of the conveyors 12, 14, the workpieces will drop out of the machine. To this end there is provided a discharge chute 64 which is best shown in FIGS. 1 and 5. The discharge chute 64 will lead the workpieces into a suitable receiving area, not shown.

It will be readily apparent that inasmuch as the workpieces are rotated by engaging the peripheries with the support shafts 16, 18, the smaller workpieces will be rotated at a higher rate than the larger workpieces. Thus when the smaller workpieces are rotated at a speed which will provide for proper cleaning thereof, and a larger workpiece is mounted within the machine, the larger workpiece will not be rotated at a sufficiently high speed to effect the proper cleaning. Under the circumstances, in accordance with this invention, the rate of rotation of the support shafts 16, 18 may be varied independently of the rotation of the conveyors 12, 14 so that the machine may be readily adjusted to provide a proper relationship of workpiece advance and workpiece rotation which will provide for adequate cleaning.

Finally, in accordance with this invention, there will be mounted in overlying relation to the machine 10 suitable conventional throwing wheels 66, 68. It will be seen that the throwing wheels are mounted to rotate in opposite directions so that the paths of the thrown abrasives will basically overlap in the center of the machine and extend the full length of the machine. Depending upon the length of the machine, more or less throwing wheels may be utilized.

Although only a preferred embodiment of the disc cleaning machine has been specifically illustrated and described herein, it is to be understood that minor variations may be made therein without departing from the spirit and scope of the invention as defined by the appended claims.

I claim:

1. A feed unit for use in an abrasive cleaner machine for circular generally plate-like workpieces, said feed unit comprising two parallel support shafts equally transversely spaced relative to and parallel to an axis for supporting and rotating a single row of workpieces about said axis, first drive means connected to said support shafts for rotating said support shafts to effect rotation of workpieces seated thereon, two parallel screw type conveyors equally transversely spaced parallel to said axis and above said support shafts for receiving workpieces seated on said support shafts and advancing such workpieces along said single row, second drive means connected to said screw type conveyors for rotating said screw type conveyors to move workpieces along said support shafts, said first and second drive means being independent of one another wherein speed of rotation of a workpiece is independent of advance rate of a workpiece.

2. A feed unit according to claim 1 wherein said screw type conveyors include a left hand screw type conveyor and a right hand screw type conveyor, and said second drive means are operative to rotate said screw type conveyors in opposite directions.

3. A feed unit according to claim 2 wherein said first drive means is operative to rotate said support shafts in the same direction.

4. A feed unit according to claim 3 wherein said first driven means include single drive means directly driving both of said support shafts.

5. A feed unit for use in an abrasive cleaner machine for circular generally plate-like workpieces, said feed unit comprising two parallel spaced support shafts, first drive means connected to said support shafts for rotating said support shafts to effect rotation of workpieces seated thereon, two parallel spaced screw type conveyors spaced above said support shafts for receiving workpieces seated on said support shafts, second drive means connected to said screw type conveyors for rotating said screw type conveyors to move workpieces along said support shafts, said first and second drive means being independent of one another wherein speed of rotation of a workpiece is independent of advance rate of a workpiece, said screw type conveyors including a left hand screw type conveyor and a right hand screw type conveyor, and said second drive means being operative to rotate said screw type conveyors in opposite directions, said first drive means being operative to rotate said support shafts in the same direction, said first drive means including single drive means directly driving both of said support shafts, said support shafts having journalled head ends and discharge ends supported by a common central drive collar and cooperating idlers.

6. A feed unit according to claim 5 wherein said support shafts have friction surfaces.

7. A feed unit according to claim 1 wherein said first drive means include single drive means directly driving both of said support shafts.

8. A feed unit for use in an abrasive cleaner machine for circular generally plate-like workpieces, said feed unit comprising two parallel spaced support shafts, first drive means connected to said support shafts for rotating said support shafts to effect rotation of workpieces seated thereon, two parallel spaced screw type conveyors spaced above said support shafts for receiving workpieces seated on said support shafts, second drive means connected to said screw type conveyors for rotating said screw type connectors to move workpieces along said support shafts, said first and second drive means being independent of one another wherein speed of rotation of a workpiece is independent of advance rate of a workpiece, said support shafts having rotatably journalled head ends and discharge ends supported by a common central drive collar and cooperating idlers.

9. A feed unit according to claim 8 wherein said support shafts have friction surfaces.

10. A feed unit according to claim 1 wherein there is an automatic workpiece feeder at first ends of said screw type conveyors, and workpiece discharge means at second ends of said screw type conveyors.

11. A feed unit according to claim 10 wherein said automatic workpiece feeder includes a workpiece hopper and a notched rotating feed wheel positioned between said hopper and said screw type conveyors.

12. A feed unit according to claim 10 wherein said discharge means includes a discharge chute at said second ends of said screw type conveyors.

13. An abrasive cleaner machine for circular generally plate-like workpieces, said machine comprising a feed unit and abrasive throwing means, said feed unit comprising two parallel support shafts equally transversely spaced relative to and parallel to an axis for supporting and rotating a single row of workpieces about said axis, first drive means connected to said support shafts for rotating said support shafts to effect rotation of workpieces seated thereon, two parallel screw type conveyors equally transversely spaced parallel to said axis and above said support shafts for receiving workpieces seated on said support shafts and advancing such workpieces along said single row, second drive means connected to said screw type conveyors for rotating said screw type conveyors to move workpieces along said support shafts, said first and second drive means being independent of one another wherein speed of rotation of a workpiece is independent of advance rate of a workpiece, said abrasive means being means for throwing abrasives longitudinally of said feed unit along said axis and spaced from said support shafts and said screw type conveyors.

14. An abrasive cleaner machine according to claim 13 wherein said abrasive throwing means is in the form of at least one abrasive throwing wheel overlying said feed unit.

15. An abrasive cleaning machine according to claim 14 wherein there are two of said throwing wheels operating in opposite directions.

* * * * *